United States Patent [19]

Aniello

[11] Patent Number: 4,765,231

[45] Date of Patent: Aug. 23, 1988

[54] SMOKE EXHAUSTING AIR CONDITIONING SYSTEM

[76] Inventor: Michael J. Aniello, 20 Valley Rd., Katonah, N.Y. 10536

[21] Appl. No.: 29,318

[22] Filed: Mar. 23, 1987

[51] Int. Cl.[4] ..... F24F 11/00

[52] U.S. Cl. ..... 98/33.1; 98/42.03

[58] Field of Search ..... 98/1, 42.03, 42.04, 98/42.06, 33.1

[56] References Cited

U.S. PATENT DOCUMENTS 3,884,133 5/1975 Miller ..... 98/42.03 X 3,926,101 12/1975 Moss ..... 98/42.03 X

FOREIGN PATENT DOCUMENTS 125342 7/1984 Japan ..... 98/42.03

*Primary Examiner*—Harold Joyce

*Attorney, Agent, or Firm*—Leo Zucker

[57] ABSTRACT

Harmful smoke is drawn from rooms in an air conditioned building by way of duct work which supplies conditioned air to the rooms during normal operation. When a potentially harmful level of smoke is detected, supply fan motors associated with the duct work are reversed in direction so as to evacuate the smoke through registers in the rooms and into the duct work. The smoke is then exhausted away from the building occupants through an outside ventilating unit. Accordingly, the building occupants will have sufficient time to evacuate the building safely without succumbing to smoke inhalation.

14 Claims, 4 Drawing Sheets

SMOKE EXHAUSTING AIR CONDITIONING SYSTEM

BACKGROUND OF THE INVENTION

1. Field of the Invention

The present invention relates generally to building ventilation systems, and more particularly to a system capable of operating to exhaust harmful smoke away from occupants of a building when a dangerous smoke level is detected.

2. Description of the Known Art

All too often we hear of persons having perished on account of building fires, not because they did not have enough time to evacuate the building from the time when flames first erupted until the building was consumed by the fire, but because they became disabled by smoke inhalation.

Many kinds of fires erupting inside today's buildings will generate extremely hazardous levels of smoke on account of their origin (e.g., chemicals, synthetic material and the like) and/or because insufficient ventilation is available to exhaust the smoke as it evolves. The latter situation is compounded by construction practices in modern buildings in which windows are permanently sealed and, thus, cannot be readily used by occupants as a means for venting smoke unless physically broken open with a heavy, hard object. It will be appreciated that during a time of panic, the smashing open of building windows by the occupants so that they will not become engulfed with smoke, is not a practice that should be taught or encouraged. Particularly at floor levels high above the street, the breaking open of modern floor-to-wall window panels would only further endanger the building occupants as well as persons below at the street level.

Most local ordinances today mandate that public buildings contain some form of smoke and/or fire detection apparatus, and suitable alarm mechanisms to alert occupants to a fire or smoke condition. Stairways or other means of egress from the building are provided for the occupants to use in such an emergency. Unfortunately, most occupants do not familiarize themselves with the location of fire exits provided in buildings so that when an alarm is sounded, they must take time to learn the whereabouts of the appropriate doors and stairways. Even for those occupants with prior knowledge of the emergency exits, the sudden eruption of a dense smoke producing fire will tend to blind them and cause panic. If an occupant cannot see his or her way clear to a fire exit even when crawling at floor level, the chances of safely exiting the building prior to succumbing to smoke inhalation are drastically reduced.

As far as is known, no system exists by which a potentially dangerous level of smoke quickly evolving inside a building, can be positively and rapidly exhausted away from the building occupants at least to give them sufficient time to evacuate the building safely. Most buildings today include air conditioning systems in which conditioned air is supplied through a supply duct system under a slightly positive pressure with the aid of a supply motor. The supply duct system thus is arranged to force air into, rather than evacuate a room with which the duct system communicates through a register. Further, local ordinances require the provision of fire dampers at certain locations along the length and inside building duct systems to prevent propagation of a fire through the ducting when the dampers close. A fuseable link associated with each damper melts at a certain elevated temperature indicative of a fire in the vicinity of the damper, thus causing the damper to move from an open to a closed position and block the ducting passage.

SUMMARY OF THE INVENTION

An object of the invention is to overcome the mentioned shortcomings of the known fire alarm systems.

Another object of the invention is to provide a system and a method by which hazardous smoke can be evacuated quickly from rooms of a building at least as long as necessary to allow the occupants to evacuate safely.

A further object of the invention is to provide an integrated smoke exhausting/air conditioning system which during normal operation functions as a conventional building air conditioning system but, when a hazardous smoke level is detected, rapidly draws the smoke out of the rooms through a common air conditioning duct system.

Another object of the invention is to provide a smoke exhausting/air conditioning system in which the required fire dampers remain, but are disabled from closing to allow smoke to pass unobstructed through the associated duct system to be exhausted only for a time sufficient to allow the occupants to exit the building safely.

According to the invention, a smoke exhausting air conditioning system for alleviating effects of smoke inhalation on building occupants, includes air conditioner means for producing a supply of conditioned air for the occupants to breathe, a first duct system coupled to the air conditioner means for delivering conditioned air to the building rooms, and a number of air registers located in the rooms and opening into the first duct system. Reversible supply motor means is associated with the first duct system to draw the conditioned air from the air conditioner means through the first duct system, and expel conditioned air out of the registers into the rooms when operating in an air supply mode. Smoke detector means associated with the rooms detects a potentially dangerous level of smoke and produces a corresponding alarm signal. Processor means coupled to the supply motor means and the smoke detector means, causes the supply motor means to operate in the supply mode in the absence of the alarm signal, and to operate in a smoke exhaust mode when the alarm signal is produced by the smoke detector means. In the smoke exhaust mode, the supply motor means is reversed so as to draw smoke out of the rooms through the registers and the first duct system. Smoke vent means coupled to the first duct system, exhausts smoke drawn from the rooms when the supply motor means is reversed, safely away from the occupants.

According to another aspect of the invention, a method of exhausting harmful smoke from rooms in an air conditioned building so that occupants have enough time to evacuate without succumbing to smoke inhalation, includes the steps of detecting a potentially dangerous level of smoke, reversing the direction of operation of supply motor means from one in which conditioned air is drawn through a first duct system and expelled out of registers located in rooms of the building, to one in which smoke evolving in the rooms is drawn through the registers into the first duct system when the dangerous level of smoke is detected, and exhausting the smoke drawn from the rooms out of the first duct system and away from the occupants.

The various features of novelty which characterize the invention are pointed out with particularity in the claims annexed to and forming a part of the present disclosure. For a better understanding of the invention, its operating advantages and specific objects attained by its use, reference should be had to the accompanying drawing and descriptive matter in which there is illustrated and described a preferred embodiment of the invention.

DETAILED DESCRIPTION OF THE INVENTION

Figure 1:
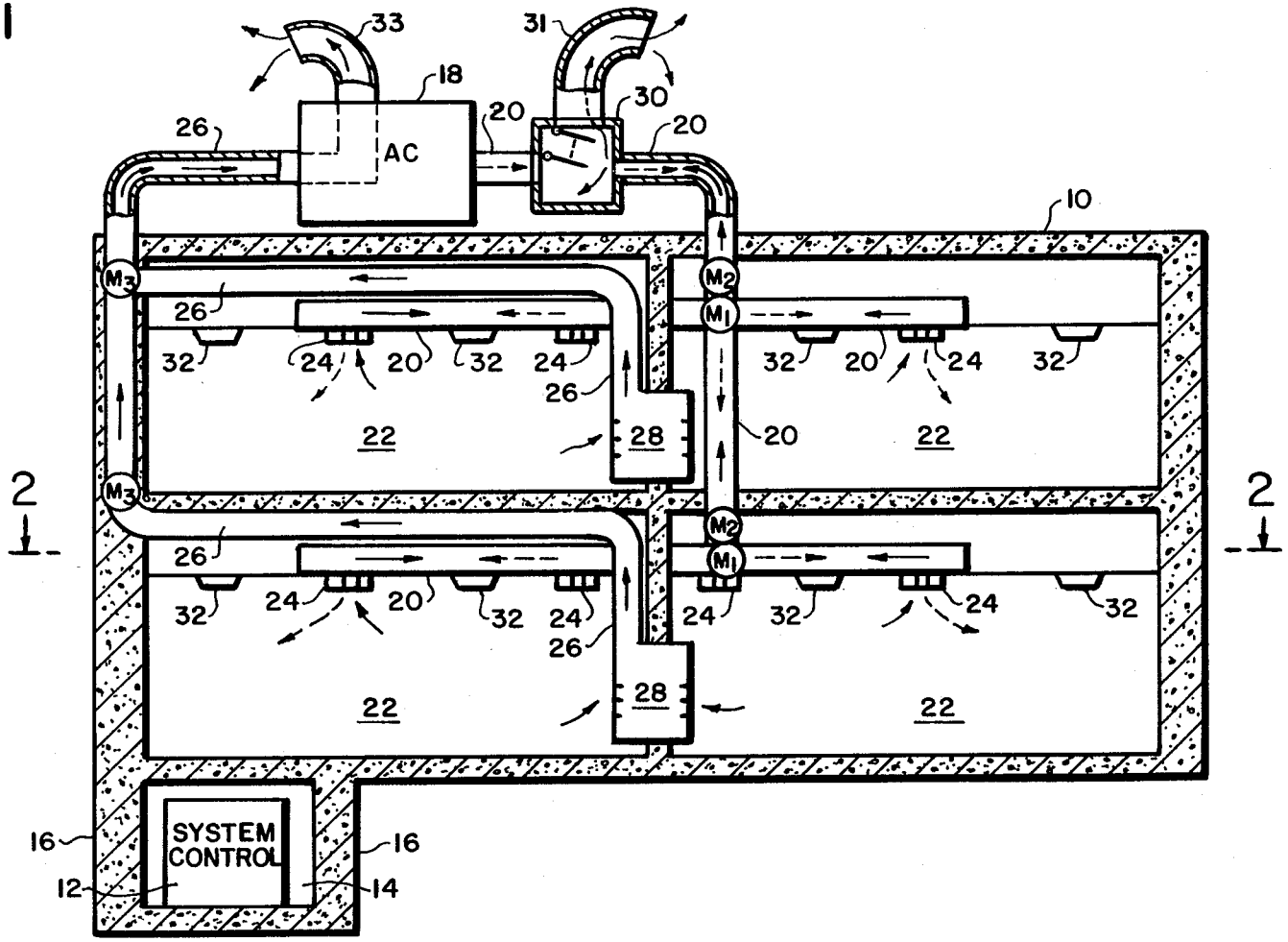
FIG. 1 is a side elevational view, partly in section, of an integrated smoke exhaust/air conditioning system installed in a multi-level building according to the invention.

FIG. 1 is a side view, partly in section, of a two-story building 10 in which an integrated smoke exhaust/air conditioning system is installed according to the present invention.

A system control unit 12 is housed in a temperature controlled room 14 with fire-proof walls 16. Room 14 may be located, for example, below ground and surrounded from other parts of the building 10 by concrete walls and ceiling. The system control unit 12 monitors and controls all normal air conditioning functions by components of the present system, and is also programmed to operate the system in a smoke exhaust mode as will be explained in connection with FIGS. 3 and 4.

A roof-top air conditioning unit 18 including conventional refrigeration components, produces a supply of conditioned air for breathing by the building occupants. The supply air, shown in FIG. 1 by arrows in dashed form, is coupled from the air conditioner unit 18 to a supply duct system 20. The supply duct system 20 delivers the conditioned air to individual rooms 22 of the building 10. Specifically, a number of ceiling air registers 24 are coupled into the supply duct system 20 and are located in each of the rooms 22. Reversible supply motors $M_1$ are provided with associated fans (not shown) in the supply duct system 20 in the area of the ceiling of each level of the building 10. During an air supply mode of operation, the supply fan motors $M_1$ draw conditioned air from the air conditioner unit 18 through the supply duct system 20 and cause the conditioned air to be expelled out of the registers 24 into the rooms 22, as shown by the dashed arrows.

A return duct system 26 is coupled at one end to the air conditioner unit 18 and branches at each building level to connect with a return port or register 28, to allow excess conditioned air in each of the rooms 22 to exit through the return duct system 26 while conditioned air is delivered to the rooms through the supply duct system 20.

An exhaust fan motor $M_3$ is associated with the return duct system 26 in the region of the ceiling of each of the building levels. In particular, exhaust motors $M_3$ with associated fans (not shown) serve to cause smoke evolving in the rooms 20 to be drawn into the return duct system 26 through the return ports 28 when the present system is in the smoke exhaust mode of operation.

A controllable smoke vent unit 30 is connected in line with the supply duct system 20 on the roof of the building 10, for exhausting smoke drawn from the rooms 22 by the reversed supply motors $M_1$, away from the building occupants when the present system operates in the smoke exhaust mode. During the normal mode of operation when conditioned air is supplied to the rooms 22 through the supply duct system 20, the smoke vent unit 30 simply assumes a closed configuration to prevent conditioned air from escaping outside the unit. In the smoke exhaust mode, a passage in the vent unit 30 leading to the air conditioner unit 18 is blocked, and smoke (shown in the form of solid arrows in FIG. 1) drawn from the rooms 22 into the supply duct system 20 is directed out of a chimney part 31 of the vent unit 30. Another chimney part 33 on the air conditioner unit 18 acts to exhaust smoke drawn into the return duct system 26 by the exhaust motors $M_3$.

A number of auxiliary of smoke fan motors $M_2$ are arranged each in the supply duct system 20 at a location near an associated supply motor $M_1$. The smoke motors $M_2$ and associated fans (not shown) operate only when the present system is in the smoke exhaust mode, and assist the supply motors $M_1$ to increase the amount of smoke drawn out of the rooms 22 through the supply duct system 20 and delivered to the smoke vent unit 30. A number of smoke detector units 32 are arranged on the ceilings of each of the rooms 22, at locations where smoke would tend to rise or accumulate should an uncontrolled fire erupt in any of the rooms. The smoke detector units 32, fan motors $M_1$, $M_2$ and $M_3$, air conditioner unit 18 and smoke vent unit 30 are all connected via suitable wiring (not shown in FIG. 1) to the system control unit 12.

Figure 2:
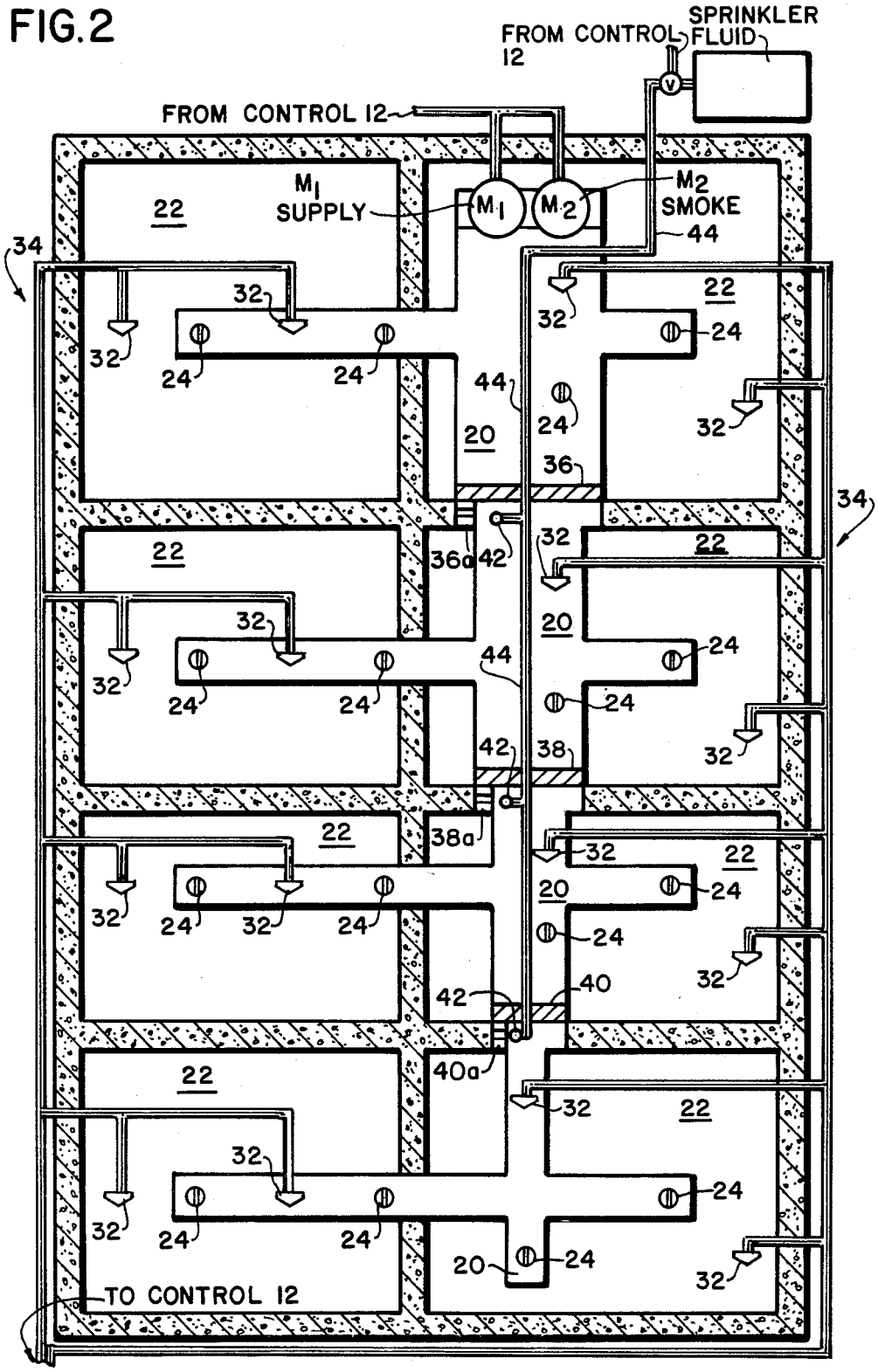
FIG. 2 is a top view of the installation of FIG. 1 as taken along line 2—2 in FIG. 1.

FIG. 2 is a top view of one of the floor levels in the building 10 of FIG. 1 as seen from the ceilings of rooms 22 on the level. Only the supply duct system 20 arranged at the ceilings of the rooms 22 is shown in FIG. 2. Not shown in the Figure are the return registers 28, the return duct system 26 and the exhaust motor $M_3$, the arrangement of which at the level in FIG. 2 would be apparent to one skilled in the art.

Two smoke detector units 32 are shown at the ceiling levels at each of the rooms 22 in FIG. 2. The precise number and location of the smoke detector units 32 for each of the rooms should, however, be based upon the size of each room and the area or areas within each room where smoke generated by an erupting fire would tend to rise or accummulate for detection by the units 32. When a level of smoke potentially dangerous to occupants of the room is sensed by any of the detector units 32, the unit produces a corresponding alarm signal which is coupled to the system control unit 12 over an alarm signal cable 34.

The supply duct system 20 begins its run along the ceiling of the building level shown in FIG. 2, with relatively large size ducting and an associated supply fan motor $M_1$ for the particular building level as shown toward the top of FIG. 2. According to the invention, the supply motors $M_1$ at each building level can be reversed in direction of operation by conventional electric switching or mechanical means, in response to suitable control signals from the system control unit 12.

That is, when the present system is in the air supply mode of operation, the motors $M_1$ draw conditioned air from the air conditioner unit 18 and produce a pressurized supply of the conditioned air within the supply duct system 20, so as to cause the air to be expelled out the ceiling air registers 24. When reversed, however, the motors $M_1$ cause a reduction in pressure within the supply duct system 20, thus drawing any smoke evolving in the rooms 22 through the registers 24 and delivering the smoke under pressure to the vent unit 30 (FIG. 1). At such time, the vent unit 30 exhausts the smoke through the chimney part 31.

The auxiliary motor $M_2$ is located near the supply motor $M_1$ at each floor level as shown in FIG. 2, its purpose being only to assist the supply motor $M_1$ when the latter is reversed in the smoke exhaust mode and the detected smoke level in any of the rooms 22 is not diminished to an acceptable level within a predetermined period of time.

Three fire dampers 36, 38, 40 are arranged within the supply duct system 20 in FIG. 2. The dampers 36, 38, 40 are generally required by local building codes to be provided in main duct systems at locations where the duct work passes through partitioned walls separating adjacent rooms. Should a fire erupt in one of the rooms, adjacent dampers will shut the duct work closed when the elevated temperature causes associated damper fuse mechanisms **36*a*, 38*a* or 40*a*** to melt.

It will be appreciated that when the present system is in the smoke exhaust mode, none of the dampers 36, 38 or 40 can be allowed to close notwithstanding elevated temperatures. Otherwise, any smoke generated in rooms beyond the first closed damper upstream of the reversed supply motor $M_1$ will not be evacuated through the supply duct system 20. Therefore, according to the invention, a sprinkler head 42 is positioned adjacent each fuse mechanism **36*a*, 38*a*, 40*a*, for directing a cooling jet toward the associated fuse mechanism to maintain the dampers 36, 38, 40 in an open position during an initial stage of the smoke exhaust mode. Each sprinkler head 42 connects to a sprinkler supply line 44 which may run in close proximity to the supply duct system 20 as shown in FIG. 2. The supply of fluid to the sprinkler supply line 44 is controlled by the system control unit 12**.

Figure 3:
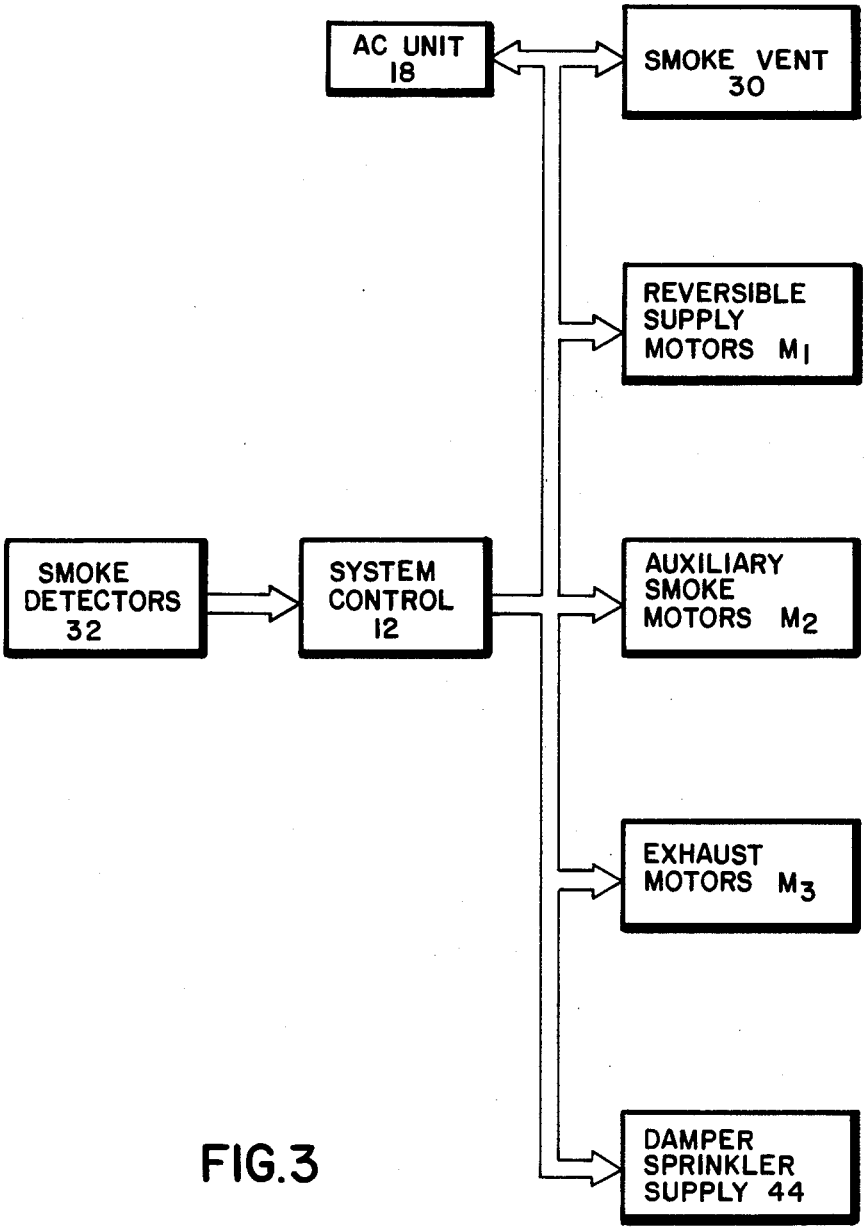
FIG. 3 is a schematic block diagram of a smoke exhaust control system according to the invention.
Figure 4:
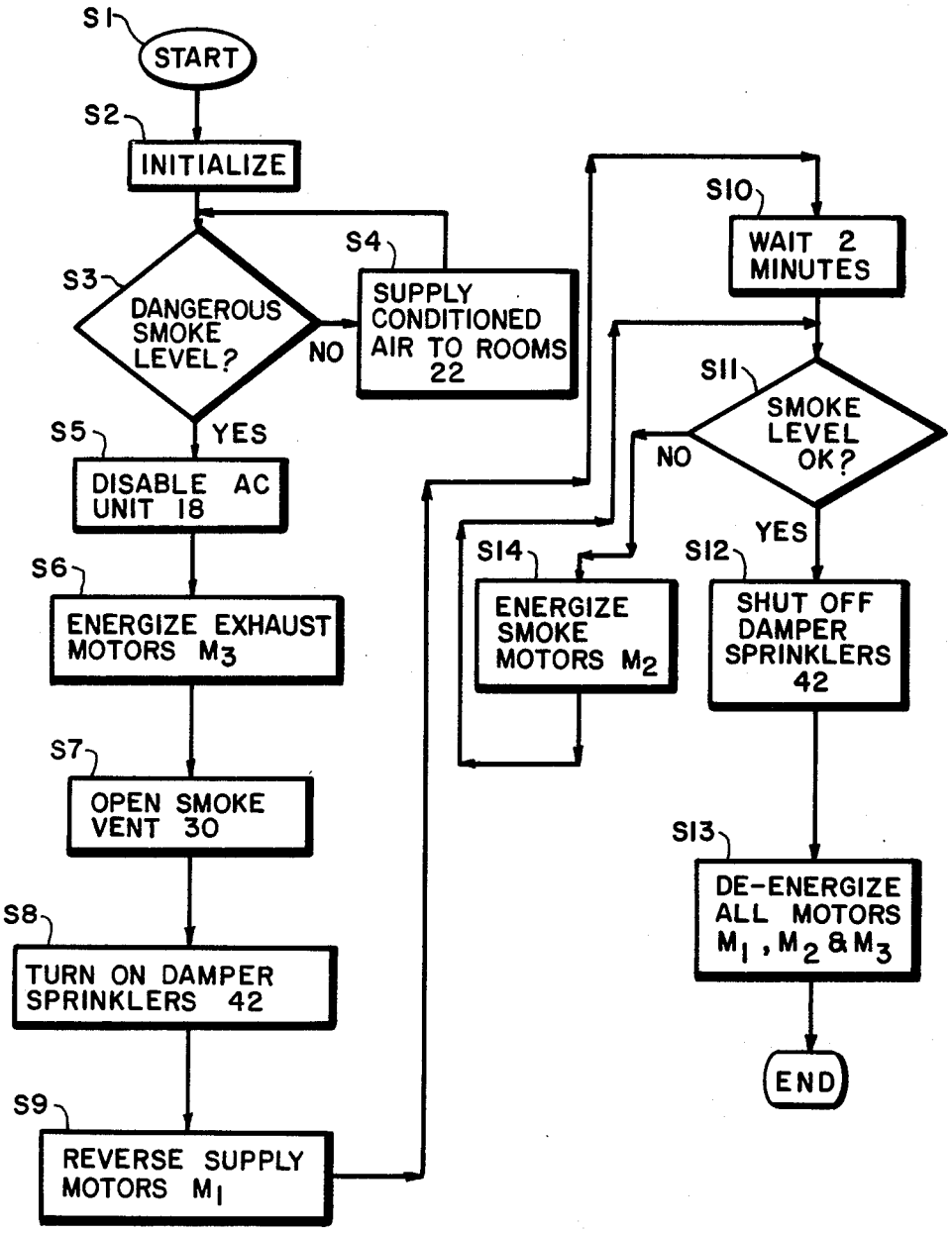
FIG. 4 is a flow chart for explaining the operation of the control system in FIG. 3.

FIG. 3 is a block diagram showing how the system control unit 12 is linked with the various system components shown in FIGS. 1 and 2. FIG. 4 is flow chart for explaining operational steps carried out by the present system when arranged as in FIGS. 1–3.

After system start-up (Step S1 in FIG. 4), initial operating parameters for the present system are entered in step S2 in control unit 12. Such operating perameters may include, for example, a level of smoke which when detected by any of the smoke detector units will cause the system to switch from an air supply to a smoke exhaust mode; the number of detector units 32 which must issue an alarm signal prior to switching to the exhaust mode; the sequence in which the exhaust motors $M_3$ and the smoke motors $M_2$ are to be energized and the sequence in which the supply motors $M_1$ are to be reversed; the system wait time between reversal of the supply motors $M_1$ and energization of smoke motors $M_2$ if an acceptable smoke level is not obtained; and the like.

In step S3 control unit 12 monitors, through the smoke detectors 32, whether or not a dangerous smoke level is present in one or more of the building rooms 22. In the absence of a harmful level of smoke, conditioned air is supplied to the rooms through the duct system 20 in step S4.

If, in step S3, it is judged that a level of smoke potentially dangerous to the building occupants is present, control unit 12 disables the air conditioner unit 18 in step S5. That is, all electrical power provided to the AC unit 18 to run components (e.g., compressors) in the unit 18 is cut off. Further, if the exhaust motors $M_3$ are not ordinarily energized to maintain a return flow through the return duct system 26 in the air supply mode, the motors $M_3$ are energized in step S6 in the smoke exhaust mode. In step S7, the smoke vent unit 30 is actuated to direct smoke drawn by the reversed motors $M_1$ through the duct system 20, through the chimney part 31 away from the building occupants. A supply of sprinkler fluid is turned on in step S8, to cause cooling fluid from the sprinkler heads 42 to impinge upon the damger fuse mechanisms **36*a*, 38*a* an 40*a*. Then, in step S9**, the supply motors $M_1$ are reversed in a designated sequence.

The system control unit 12 then enters a holding or wait period in step S10, during which smoke is exhausted by motors $M_1$ and $M_3$. In the illustrated embodiment, a wait period of not more than about 2 minutes is suggested. It is believed that the maximum time a person can breathe in dense levels of smoke without becoming disabled is slightly over 4 minutes. Other wait periods may be selected depending on existing building fire control provisions, and all other relevant factors.

When the wait period expires, it is checked in step S11 if the smoke level in the building is diminished to a level sufficient to allow fire-fighting personnel to enter the building and extinguish the source of the smoke. If the smoke level is sufficiently low, control unit 12 shuts off the supply of sprinkler fluid to the sprinkler heads 42 in step S12, thus allowing the dampers 36, 38, 40 to carry out their normal function and close if sufficiently elevated temperatures are still present. In step S13 all motors $M_1$, $M_2$ and $M_3$ are de-energized, and the system ceases operation. If, in step S11, the smoke level remains unsatisfactory after the wait period of step S10, the smoke motors $M_2$ are energized in a determined sequence in step S14 to assist the reversed supply motors $M_1$ in drawing smoke out of the building 10. When the smoke level is low enough to permit personnel to enter the building, operation returns to steps S12 and S13.

It will be appreciated that the present system is one that can be implemented with existing building air conditioning systems, and with additional components easily brought in place. Since in most building fires the air conditioning system duct work remains undamaged, smoke should be exhausted effectively by the present system from a burning building, at least long enough to permit a safe evacuation.

Various modifications of the present system will be apparent, without departing from the scope of the invention. For example, although all of the smoke detector units 32 are shown exposed on the ceilings of the building rooms 22, it may be desirous to install some of the detector units 32 within the supply duct system 20, return duct system 26, or both. Installation of smoke detector units within the duct systems 20, 26 will, of course, enable the system control unit 12 to keep account of the volume of smoke being drawn through the duct systems during the smoke exhaust mode.

The sequences in which the motors $M_1$ are reversed, and in which motors $M_2$ and $M_3$ are energized, may be such that the motors closest to the detector units 32 sensing the greatest quantity of smoke are activated first to exhaust the smoke. Motors located remotely of the smoke origin may be activated later, or not at all if the smoke is confined within a determined area of the building 10. Enabling the system control unit 12 to activate the motors according to any particular scheme in response to detected smoke levels throughout the building 10, could be accomplished through conventional system programming techniques.

I claim:

1. A smoke exhausting air conditioning system for alleviating effects of smoke inhalation on occupants of rooms in a building when an uncontrolled fire erupts, comprising:

air conditioner means for producing a supply of conditioned air for breathing by the building occupants;

a first duct system coupled to said air conditioner means for delivering the conditioned air to individual rooms of the building;

a number of air registers coupled into said first duct system and located in said rooms;

reversible supply fan motor means associated with said first duct system and in the vicinity of the individual building rooms, for drawing the conditioned air from said air conditioner means through the first duct system and expelling the conditioned air out of said registers into said rooms when in an air supply mode of operation;

smoke detector means associated with said rooms for detecting a level of smoke potentially dangerous to the building occupants and for producing a corresponding alarm signal;

processor means coupled to said supply fan motor means and said smoke detector means, for causing said supply fan motor means to operate in said supply mode in the absence of said alarm signal, and to operate in a smoke exhaust mode when said alarm signal is produced by said smoke detector means wherein said supply fan motor means is reversed to draw smoke out of said rooms through said registers and said first duct system when in said smoke exhaust mode;

smoke vent means coupled to said first duct system for exhausting smoke drawn from the rooms by the reversed supply motor means, away from the occupants;

a number of first fire dampers at certain locations within said first duct system for preventing a fire from propagating beyond said locations in said first duct system;

first fuse means associated with said first dampers for causing the dampers to change from an open position to a closed position when said first fuse means is heated to a certain temperature by the fire; and first duct sprinkler means associated with said first duct system and coupled to said processor means, for directing a cooling fluid jet toward said first fuse means to maintain said first dampers in said open position when said smoke detector means produces said alarm signal, so that the smoke drawn through said registers is allowed to pass unobstructed in said first duct system to said smoke vent means.

2. The smoke exhausting system according to claim 1, including:

a second dust system;

return port means associated with said rooms and coupled into said second duct system for allowing excess conditioned air in said rooms to exit through the second duct system when the conditioned air is delivered to the rooms through said first duct system; and exhaust fan motor means associated with said second duct system for causing smoke evolving in the rooms to be drawn into said second duct system through said return port means.

3. The smoke exhausting system according to claim 1, including smoke fan motor means associated with said first duct system and responsive to said processor means, for assisting said said supply fan motor means when in said smoke exhaust mode and increasing the amount of smoke drawn out of said rooms through said first duct system.

4. The smoke exhausting system according to claim 1, wherein said smoke detector means includes a number of individual smoke detector units, at least some of which are located inside said first duct system.

5. The smoke exhausting system according to claim 2, wherein said smoke detector means includes a number of individual smoke detector units, at least some of which are located inside said second duct system.

6. The smoke exhausting system according to claim 2, including a number of second fire dampers at certain locations within said second duct system for preventing fire from propagating beyond said locations in said second duct system, second fuse means associated with said second dampers for causing the dampers to change from an open to a closed position when said second fuse means is heated to a certain temperature by the fire, and second duct sprinkler means associated with said second duct system and coupled to said processor means, for directing a cooling fluid jet toward said second fuse means to maintain said second dampers in said open position when said smoke detector means produces said alarm signal, so that smoke drawn through said return port means is allowed to pass unobstructed in said second duct system.

7. The smoke exhausting system according to claim 1, wherein said processor means includes means for activating said first duct sprinkler means for a determined time after said alarm signal is produced by said smoke detector means, the determined time not exceeding that needed for the occupants to evacuate the building safely.

8. The smoke exhausting system according to claim 6, wherein said processor means includes means for activating said second duct sprinkler means for a determined time after said alarm signal is produced by said smoke detector means, the determined time not exceeding that needed for the occupants to evacuate the building safely.

9. A method of exhausting harmful smoke from the rooms of an air conditioned building when an uncontrolled fire erupts, so that the building occupants have sufficient time to evacuate without succumbing to smoke inhalation, comprising:

detecting a level of smoke potentially dangerous to the building occupants;

reversing the direction of operation of supply fan motor means from one in which conditioned air is drawn through a first duct system and expelled out of registers located in rooms of the building, to one in which smoke evolving in the rooms is drawn through said registers into the first duct system when the dangerous level of smoke is detected;

exhausting the smoke drawn from the rooms and into the first duct system, out of the first duct system and away from the occupants; and directing a first cooling fluid jet toward first fuse means associated with first fire dampers in the first duct system when the potentially dangerous level of smoke is detected;

thereby ensuring that the first dampers will remain in an open position notwithstanding the presence of fire in the vicinity of the first duct system, and allowing smoke drawn through the room registers to pass unobstructed in said first duct system to be exhausted away from the building occupants.

10. The method of claim 9, including:

arranging a second duct system in the building and coupling the second duct system to return port means associated with the rooms, thereby allowing excess conditioned air to exit through the second duct system when the conditioned air is delivered to the rooms through the first duct system, and causing, through the use of exhaust fan motor means, smoke evolving in the rooms to be drawn into the second duct system through the return port means.

11. The method of claim 9, including placing auxiliary smoke fan motor means in operating relation with the first duct system thereby assisting the supply fan motor means in drawing the evolving smoke in said rooms through the room registers when the potentially dangerous level of smoke is detected and the direction of operation of the supply fan motor means is reversed.

12. The method of claim 10, including directing a second cooling fluid jet toward second fuse means associated with second fire dampers in the second duct system when the potentially dangerous level of smoke is detected, thereby ensuring that the second dampers will remain in an open position notwithstanding the presence of fire in the vicinity of the second duct system, and allowing smoke drawn through the return port means to pass unobstructed in said second duct system to be exhausted away from the building occupants.

13. The method of claim 9, including determining the amount of time necessary to enable the occupants to evacuate the building safely, and directing said first cooling jet toward the first fuse means for a time not exceeding said determined time after the dangerous level of smoke is detected.

14. The method of claim 12, including determining the amount of time necessary to enable the occupants to evacuate the building safely, and directing said second cooling jet toward the second fuse means for a time not exceeding said determined time after the dangerous level of smoke is detected.

* * * * *